United States Patent [19]

Rosenberg

[11] 4,100,924

[45] Jul. 18, 1978

[54] SHOULDER STRAP

[76] Inventor: Frieda M. Rosenberg, 145 Crescent Beach Dr., Burlington, Vt. 05401

[21] Appl. No.: 807,119

[22] Filed: Jun. 16, 1977

[51] Int. Cl.[2] ..... A41C 3/00

[52] U.S. Cl. ..... 128/510; 2/2

[58] Field of Search ..... 128/510; 2/2, 267, 268; 150/1; 190/1

[56] References Cited

U.S. PATENT DOCUMENTS 2,763,866 9/1956 Anderson ..... 2/2 UX 3,025,859 3/1962 Rosenberg ..... 128/510

*Primary Examiner*—Doris L. Troutman

*Attorney, Agent, or Firm*—Sherman & Shalloway

[57] ABSTRACT

A shoulder strap for supporting a load from a person's shoulder extends over the shoulder and includes a pair of spaced single pockets, each of which contain a relatively rigid plastic insert. The inserts enable the strap to support the load on natural load-carrying portions of the shoulder, avoiding concentrated loading of nerve centers, blood vessels and sensitive tissue.

10 Claims, 12 Drawing Figures

SHOULDER STRAP

BACKGROUND OF THE INVENTION

1. Field of the Invention

This invention relates to shoulder load-carrying strap construction, and more particularly to an improved shoulder load-carrying strap for brassieres, foundation garments, artificial limbs, plaster casts, knapsacks, and similar types of shoulder load carrying or shoulder supported articles.

2. Prior Art

In applicant's previous patent, U.S. Pat. No. 3,025,859, a plurality of stays or stiffeners were inserted in the front and rear portions of a shoulder strap to provide relatively large load bearing areas. Utilization of a plurality of stiffeners requires a plurality of pockets in order to prevent the stiffeners from overlapping one another. In order to form the plurality of pockets, separate rows of stitches must be made in the fabric of the strap. The time required to form these separate rows of stitches is considerable and can drastically increase the length of time required to manufacture each strap. Since the stitching required for this type of strap is generally done on manually-fed and manually-manipulated sewing machines, the labor cost for stitching is high. Consequently, any reduction in the amount of stitching necessary to produce each strap will result in a considerable reduction in the cost of each strap. Since these straps are a volume item, the commercial success thereof could be greatly enhanced by decreasing the cost of each strap.

When carrying a relatively heavy load, the plurality of stiffeners can become uncomfortable, because the edges of the intermediate stiffener can bite into the flesh, and the flesh can be pinched between adjacent stiffeners.

OBJECTS OF THE INVENTION

With the foregoing considerations in mind, it is a main object of the invention to provide a novel and improved shoulder carrying strap construction which involves simple components, which provides increased comfort in supporting loads on the wearer's shoulders, and which prevents interference of the strap with arterial or venous drainage.

A further object of the invention is to provide an improved shoulder load-carrying strap suitable for brassieres, foundation garments, and various other articles supported on the wearer's shoulders, the strap construction providing a structural bridge incorporated therein giving a substantial load distribution and which enables the load to be supported on natural load-carrying parts of the human body, avoiding concentrated loading on portions of the body containing nerve centers, blood vessels and sensitive tissues.

A still further object of the invention is to provide an improved shoulder strap which enhances freedom of shoulder motion and rotation of shoulder elements, reducing pain and discomfort from the carrying of shoulder loads, and enabling heavy loads to be comfortably carried on the wearer's shoulders.

It is still an additional object of the invention to provide a shoulder strap fulfilling the foregoing objectives which is more economical to produce than the prior art and provides a greater degree of comfort than the prior art.

SUMMARY OF THE INVENTION

With the foregoing objects in mind, the instant invention contemplates a shoulder strap comprising a flexible elongated main strap portion, a widened flexible intermediate portion, and a pair of spaced, relatively flexible, flat stay-members of substantial width, secured in said intermediate portion. One of the stay members extends substantially diagonally across a major part of the width of said intermediate portion while the other stay member extends generally diagonally to the intermediate portion, whereby the members substantially bridge the scapula and clavicle of the wearer's shoulders.

BRIEF DESCRIPTION OF THE DRAWINGS

Further objects and advantages of the invention will become apparent from the following description and claims, and from the accompanying drawings, wherein:

DETAILED DESCRIPTION

Figure 1:
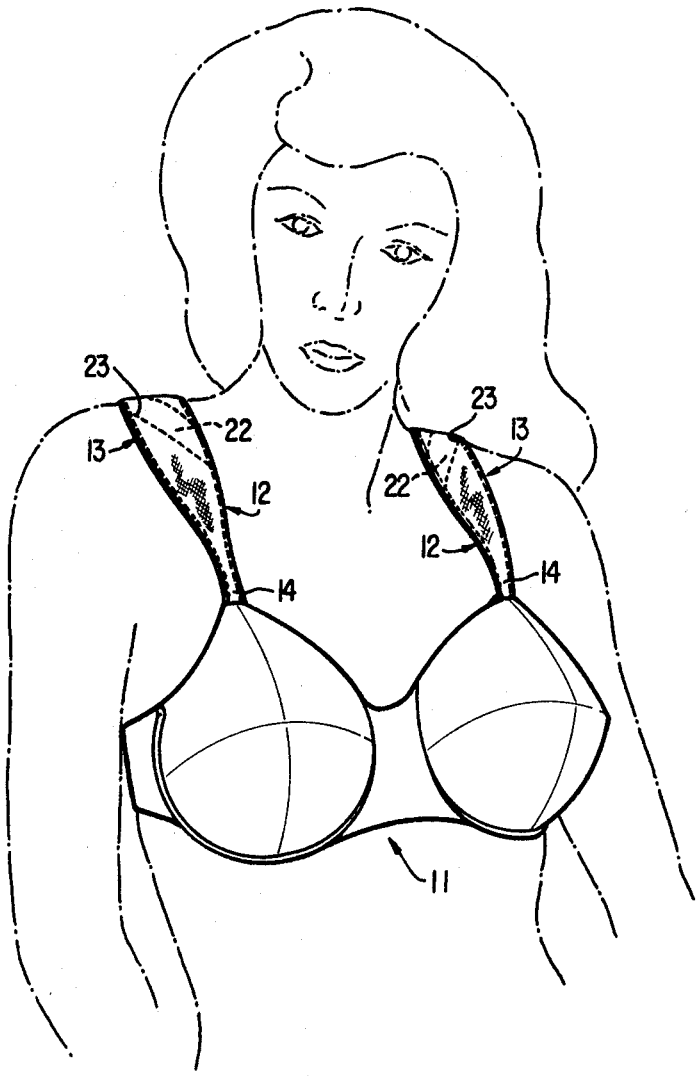
FIG. 1 is a perspective view showing an improved brassiere provided with load-supporting shoulder straps according to the present invention.

Referring to the drawings, numeral 11 designates generally a brassiere provided with a pair of shoulder straps 12,12, the straps being constructed in accordance with the present invention, while numeral **11*a* designates generally a shoulder bag suspended from a single strap 12** in accordance with the instant invention.

Each strap 12 comprises a relatively wide intermediate supporting portion 13 which is integrally connected to the respective end strap elements 14 and 15. The shoulder strap 12 thus comprises a flexible elongated main strap portion having the widened flexible intermediate portion 13. As shown in FIGS. 5, 6, 7 and 8, the strap comprises a flexible outer layer of fabric or other similar material, designated at 18 and a relatively soft flexible inner layer 19 which is adapted to be in engagement with the wearer's body and which preferably comprises relatively soft yieldable cushioning material of substantial thickness. The layers 18 and 19 are stitched together at their edges, as shown at 20, the stitching 20 extending continuously around the peripheral margin of the strap.

The end portions 14 and 15 are respectively stitched to the front and rear sides of the main supporting portion 21 of the brassiere, said main supporting portion 21 being of conventional construction.

Figure 2:
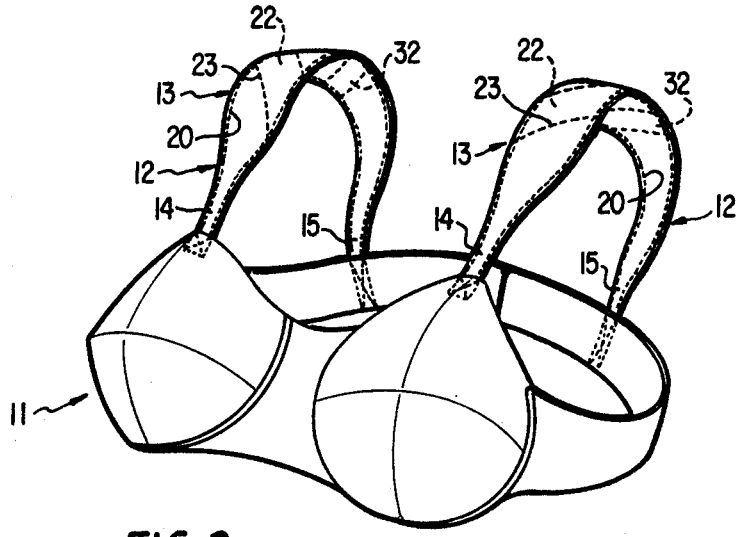
FIG. 2 is a front view of the brassiere shown in FIG. 1.

The widened intermediate portion 13 of each shoulder strap 12 contains a relatively flexible flat stay member 22. The stay member 22 is in the form of a parallelogram and is disposed with its edges diagonal to the extent of the strap. A pocket defined by a pair of diagonal rows of stitches 23 retains the stay member. The straps 12,12 are secured to the main supporting portion 21 of the brassiere with the stay members 22 directed so that they converge toward the front of the brassiere, as is clearly illustrated in FIGS. 1 and 2.

Figure 3:
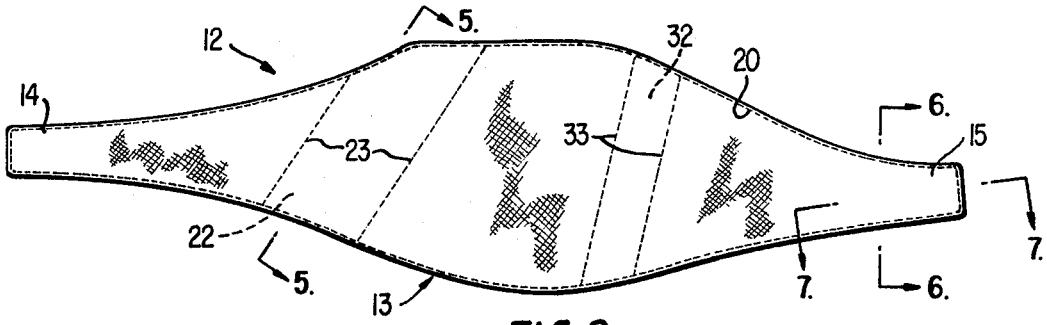
FIG. 3 is an enlarged top plan view of one of the shoulder straps employed in the brassiere illustrated in FIGS. 1 and 2.

An additional stay member 32 is provided in the widened intermediate portion 13 of each shoulder strap 12. The stay member 32 is positioned diagonally with regard to the portion 13 and is retained in a pocket, defined by a pair of diagonal rows of stitches 33. As shown in FIG. 3, the transverse stay member 32 is spaced rearwardly from the diagonal stay member 22 on the portion 13 by a distance depending upon the width of the intended wearer's shoulder, namely, on the size of the person intending to wear the strap.

The additional stay member 32 prevents the strap 12 from slipping laterally and provides additional dispersement and distribution of the weight on the garment at the rear of the shoulder.

Figure 4:
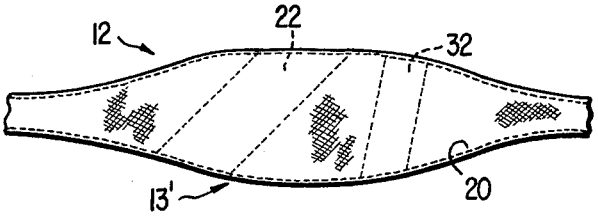
FIG. 4 is a fragmentary top plan view of a modified form of shoulder strap according to the present invention, smaller in size than the strap illustrated in FIG. 3.
Figure 5:
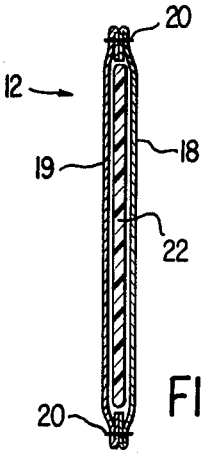
FIG. 5 in an enlarged cross-sectional view taken substantially on the line 5—5 of FIG. 3.
Figure 6:
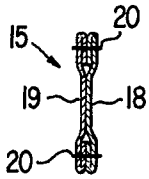
FIG. 6 is an enlarged cross-sectional view taken substantially on the line 6—6 of FIG. 3.
Figure 7:
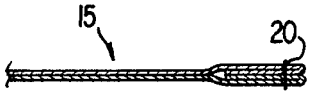
FIG. 7 is an enlarged cross-sectional view taken substantially on the line 7—7 of FIG. 3.

FIG. 3 illustrates a form of the invention wherein the frontal stay member 22 is employed and wherein the widened intermediate portion 13 of the strap is relatively large. FIG. 4 illustrates a modification showing a smaller-size version of the strap, the widened intermediate portion 13' thereof being appropriately smaller than the portion 13 of the strap shown in FIG. 3.

The stay members 22 and 32 may be made of any suitable material, such as bone, plastic, or resilient metal. However, it is preferred that the stay members 22 and 32 be made of a material such an nylon, which is flexible yet not stiff enough to dig into one's shoulder because of the diagonal displacement of the edges. The stay member 22 is angularly placed, as above described, so located with respect to the center line of the strap 12, and of suitable length that the load applied thereto by the main portion 21 of the brassiere or bag is supported by a bridging structure (defined by the parallel stay member 22 and its retaining pocket) which substantially engages over the scapula (shoulder bone) and the clavicle (collar bone) of the wearer's shoulders. This provides a relatively large load bearing area, which efficiently distributes the load attached to the straps, eliminating discomfort in the area between the shoulder and collar bone. The stay member 32 is angularly placed generally diagonally across the length of the strap and ranges in angularity from a substantially parallel relationship with the stay 22, as shown in FIG. 3, to a converging relationship for smaller sizes, as shown in FIG. 4.

This distribution of the load thus prevents interference with arterial or venous drainage, prevents being exerted on the auxiliary arteries and veins and their branches, and prevents excessive pressure on the brachial plexis area as well as on the adjacent tissues and muscles. Thus, there is no interference with the function of the nerves, blood vessels or tissues of the subjacent portions of the wearer's shoulders. Furthermore, shoulder motions may be freely made without chafing or discomfort from the load carried by the device.

Figure 8:
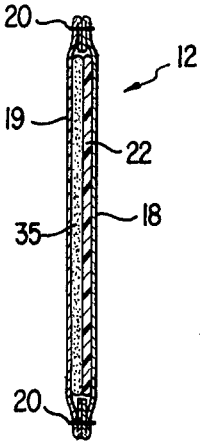
FIG. 8 is an enlarged cross-sectional view showing an embodiment of the invention which uses a resilient pad in combination with a plastic insert.

As seen in FIG. 8, a thin foam cushion 35 may be placed directly under the stays 22 and 32 to provide additional cushioning when relatively heavy loads are to be carried or supported.

Figure 9:
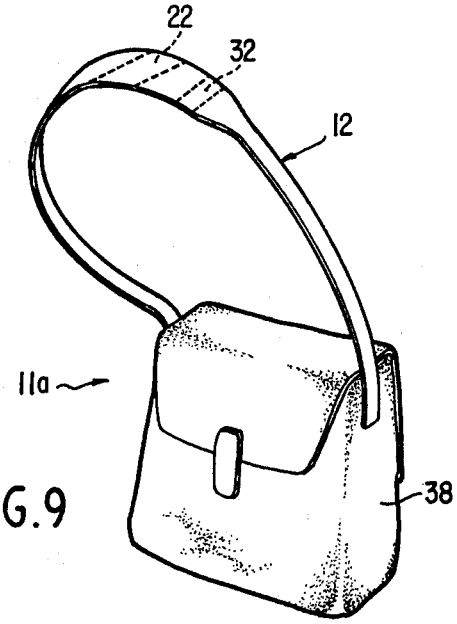
FIG. 9 is a perspective view showing a single strap in accordance with the instant invention used to suspend a bag from one's shoulder.
Figure 10:
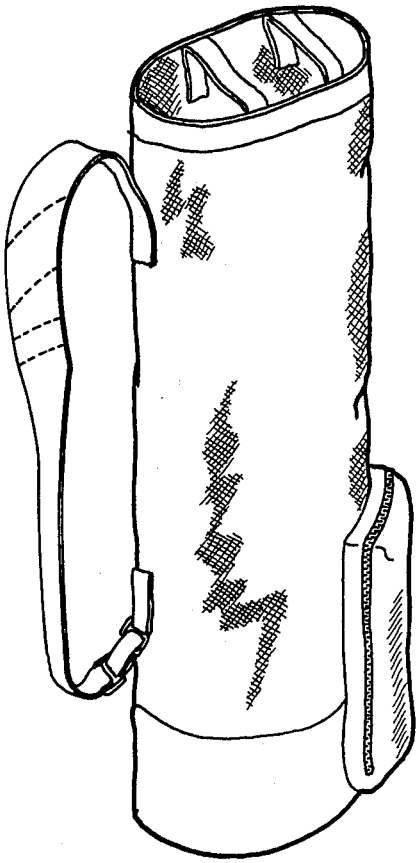
FIG. 10 is a perspective view showing a single strap according to the invention and associated with a golf bag.
Figure 11:
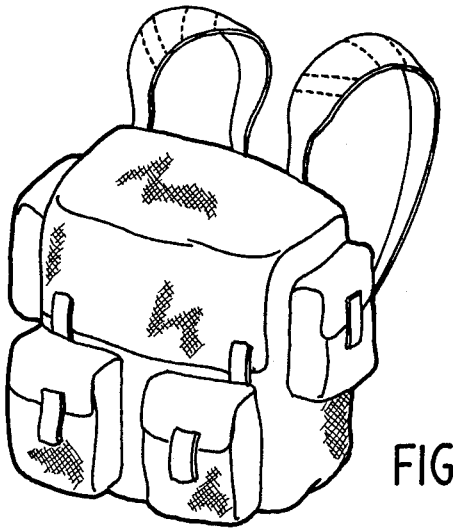
FIG. 11 is a perspective view showing straps of the present invention associated with a knapsack.
Figure 12:
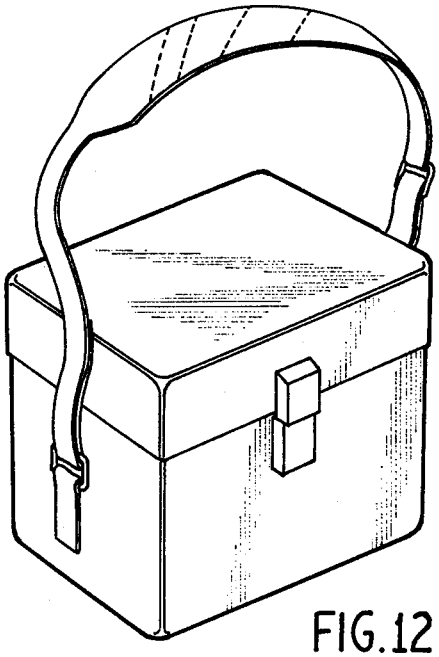
FIG. 12 is a perspective view showing a single strap according to the present invention and supporting a camera bag.

As is seen in FIG. 9, a single strap 12 may be used to support an article, such as a bag 38, from one's shoulder.

As mentioned above, different sizes of straps may be employed, in accordance with the amount of load to be supported. The improved shoulder straps above described may be employed in conjunction with any type of supporting structure adapted to be carried by the wearer's shoulders, such as brassieres, foundation garments, mechanical limbs, plaster casts, knapsacks, or the like.

While certain specific embodiments of an improved shoulder load carrying strap have been disclosed in the foregoing description, it will be understood that various modifications within the spirit of the invention may occur to those skilled in the art. Therefore, it is intended that no limitations be placed on the invention except as defined by the scope of the appended claims.

I claim:

1. A shoulder strap for extending over a person's shoulder to support a load from the person's shoulder, said strap comprising:

a flexible elongated main strap portion having end portions, each of which is secured to the load;

a widened flexible intermediate portion having front and rear ends;

a first single pocket extending diagonally to the length of the strap across the intermediate portion adjacent to the front end of the intermediate portion;

a single stay member disposed within said first pocket;

a second single pocket having a width less than the width of the first pocket and extending at an angle to the length of the strap across the intermediate portion adjacent to the rear end of the intermediate portion; and a single stay member disposed within said second pocket; whereby:

said first and second stay members substantially bridge the scapula and clavicle of the person's shoulder without interfering with arterial or venous drainage of the shoulder.

2. The shoulder strap of claim 1 wherein the strap is made of cloth and the stay members are inserts of relatively rigid plastic.

3. The shoulder strap of claim 2 wherein the second stay member extends generally parallel to the first stay member.

4. The shoulder strap of claim 2 wherein the second stay member converges with the first stay member.

5. The shoulder strap of claim 2 wherein the first stay member is substantially shaped as a parallelogram.

6. The shoulder strap of claim 5 wherein the intermediate portion tapers toward the end portions.

7. The shoulder strap of claim 6 wherein the strap is used singly to carry a load such as a bag.

8. The shoulder strap of claim 6 wherein the strap is used in conjunction with a second strap that is a mirror image of the first strap so as to support a load from both shoulders.

9. The shoulder strap of claim 7 wherein the straps support a brassiere.

10. The shoulder strap of claim 2 wherein the strap is formed of two layers of cloth which are stitched together around the periphery of the strap and wherein the pockets are formed by two spaced parallel rows of stitches located adjacent the front and rear ends of the intermediate portions.

* * * * *